US006805093B2

(12) United States Patent
Zsoldos et al.

(10) Patent No.: US 6,805,093 B2
(45) Date of Patent: Oct. 19, 2004

(54) METHOD AND APPARATUS FOR COMBINING EXHAUST GAS RECIRCULATION AND ENGINE EXHAUST BRAKING USING SINGLE VALVE ACTUATION

(75) Inventors: Jeffrey S. Zsoldos, Knoxville, MD (US); Charlie C. Kim, Martinsburg, WV (US); William A. Meacock, Carlisle, PA (US)

(73) Assignee: Mack Trucks, Inc., Allentown, PA (US)

( * ) Notice: Subject to any disclaimer, the term of this patent is extended or adjusted under 35 U.S.C. 154(b) by 44 days.

(21) Appl. No.: 10/391,427

(22) Filed: Mar. 19, 2003

(65) Prior Publication Data

US 2003/0200954 A1 Oct. 30, 2003

Related U.S. Application Data

(60) Provisional application No. 60/376,264, filed on Apr. 30, 2002.

(51) Int. Cl.[7] ..... F02D 13/04; F02M 25/07

(52) U.S. Cl. ..... 123/321; 123/568.14

(58) Field of Search ..... 123/320, 321, 123/368.14, 90.16, 90.11

(56) References Cited

U.S. PATENT DOCUMENTS

| | | | |
|---|---|---|---|
| 1,952,881 | A | 3/1934 | Minter |
| 2,585,029 | A | 2/1952 | Nettel |
| 3,396,533 | A | 8/1968 | Fischer |

(List continued on next page.)

FOREIGN PATENT DOCUMENTS

| | | | |
|---|---|---|---|
| EP | 0 105 828 | A2 | 4/1984 |
| EP | 0 750 103 | A2 | 12/1996 |
| GB | 2 340 258 | A | 2/2000 |

OTHER PUBLICATIONS

Aceves, S.M., et al., "HCCI Combustion: Analysis and Experiments", *SAE Technical Paper Series*, Government/Industry Meeting, Washington, D.C., May 14–16, 2001, 2001–01–2077, 9 pages.

*Primary Examiner*—Mahmoud Gimie
*Assistant Examiner*—Arnold Castro
(74) *Attorney, Agent, or Firm*—Rothwell, Figg, Ernst & Manbeck PC

(57) ABSTRACT

A system for accomplishing engine exhaust braking and exhaust gas recirculation for an engine having an exhaust manifold and a plurality of exhaust valves per cylinder during a four stroke engine cycle is provided. The system includes an actuation device operable to provide valve actuation of a single exhaust valve for an exhaust braking event and an exhaust gas recirculation event. The exhaust valve is not completely closed during the exhaust braking event and the exhaust gas recirculation event. The exhaust braking event includes actuating a single exhaust valve beginning during a second half of a compression stroke and a first half of an expansion stroke, and closing the exhaust valve beginning during a second half of an exhaust stroke. The exhaust gas recirculation event includes reactuating the exhaust valve beginning during a first half of an intake stroke, and closings the exhaust valve beginning during a second half of the intake stroke. Since a single exhaust valve is actuated during the exhaust braking and exhaust gas recirculation events, the overall performance of the vehicle is increased.

19 Claims, 5 Drawing Sheets

U.S. PATENT DOCUMENTS 3,676,999 A 7/1972 Oldfield
3,786,792 A 1/1974 Pelizzoni et al.
3,925,989 A 12/1975 Pustelnik
3,961,199 A 6/1976 Bronicki
4,005,578 A 2/1977 McInerney
4,075,990 A 2/1978 Ribeton
4,142,143 A 2/1979 Daniel
4,142,493 A 3/1979 Schira et al.
4,164,032 A 8/1979 Nohira et al.
4,164,206 A 8/1979 Toelle
4,215,550 A 8/1980 Dinger et al.
4,228,655 A 10/1980 Herschmann et al.
4,350,129 A 9/1982 Nakajima et al.
4,385,598 A 5/1983 Nakajima et al.
4,388,802 A 6/1983 Dinger et al.
4,393,853 A 7/1983 Groves
4,426,848 A 1/1984 Stachowicz
4,428,192 A 1/1984 Dinger et al.
4,440,140 A 4/1984 Kawagoe et al.
4,446,840 A 5/1984 Nakagawa et al.
4,450,824 A 5/1984 Ando et al.
4,452,217 A 6/1984 Kawamura et al.
4,453,381 A 6/1984 Dinger
4,502,283 A 3/1985 Wandel
4,594,993 A 6/1986 Engel et al.
4,596,225 A 6/1986 Oonaka et al.
4,625,702 A 12/1986 Onishi
4,738,110 A 4/1988 Tateno
4,848,086 A 7/1989 Inoue et al.
4,996,966 A 3/1991 Hitomi et al.
5,090,204 A 2/1992 Bonitz et al.
5,146,890 A 9/1992 Gobert et al.
5,203,830 A 4/1993 Faletti et al.
5,230,320 A 7/1993 Hitomi et al.
5,363,091 A 11/1994 Kotwicki et al.
5,406,918 A 4/1995 Joko et al.
5,408,979 A 4/1995 Backlund et al.
5,440,880 A 8/1995 Ceynow et al.
5,485,819 A 1/1996 Joko et al.
5,586,531 A 12/1996 Vittorio
5,601,068 A 2/1997 Nozaki
5,603,292 A 2/1997 Hakansson
5,625,750 A 4/1997 Puskorius et al.
5,703,777 A 12/1997 Buchhop et al.
5,758,309 A 5/1998 Satoh
5,771,867 A 6/1998 Amstutz et al.
5,787,859 A 8/1998 Meistrick et al.
5,806,476 A 9/1998 Hakansson
5,809,964 A 9/1998 Meistrick et al.
5,890,359 A 4/1999 Enander
5,921,223 A 7/1999 Fukuma
5,924,280 A 7/1999 Tarabulski
6,009,862 A 1/2000 Wanat et al.
6,012,424 A 1/2000 Meistrick
6,029,452 A 2/2000 Halimi et al.
6,079,211 A 6/2000 Woollenweber et al.
6,082,328 A 7/2000 Meistrick et al.
6,085,721 A 7/2000 Dodi et al.
6,125,828 A 10/2000 Hu
6,152,104 A 11/2000 Vorih et al.
6,170,474 B1 1/2001 Israel
6,189,504 B1 2/2001 Israel et al.
6,234,143 B1 5/2001 Bartel et al.
6,244,257 B1 6/2001 Hu
6,257,213 B1 * 7/2001 Maeda ..... 123/568.14
6,321,717 B1 11/2001 Faletti
6,325,043 B1 12/2001 Meistrick et al.
6,354,254 B1 3/2002 Usko

* cited by examiner

METHOD AND APPARATUS FOR COMBINING EXHAUST GAS RECIRCULATION AND ENGINE EXHAUST BRAKING USING SINGLE VALVE ACTUATION

BACKGROUND OF THE INVENTION

1. Field of the Invention

The present invention relates generally to the field of exhaust gas recirculation and engine exhaust braking. Specifically, the invention relates to a method and system for combining exhaust gas recirculation and exhaust braking using single valve actuation.

2. Description of the Background Art

Exhaust braking is an engine operating mode wherein the engine is reconfigured during operation to provide a braking effect to a vehicle. This may be desirable or necessary when regular wheel brakes are inadequate to provide complete braking. An example is a need for powerful and prolonged braking operations on steep grades, such as on mountain roads. Exhaust braking finds particular applicability on large vehicles having high wheel weights and correspondingly high momentum, and where conventional wheel brakes may fade or fail under high loading conditions or under prolonged use.

An engine brake works by opening exhaust valves at or near the end of the compression stroke of an associated cylinder. During the compression stroke of an engine, the air in a cylinder is compressed, requiring a work input by the engine. In normal engine operation, the combustion or expansion stroke follows the compression stroke and recoups the work expended during the compression stroke. The opening of the exhaust valve near the end of the compression stroke means that no expansion of the compressed air occurs, with the air being exhausted from the engine (preferably, fuel is not injected into the engine during exhaust brake operation so that fuel is not passed through the engine unburned). The net result is that during exhaust brake operation the engine is absorbing power and not generating power. The engine exhaust brake is therefore an efficient braking system that can be used as a supplement to or a substitute for conventional wheel brakes, and may be used for repeated and extended braking operations.

Exhaust brakes may use special components, or may be realized using existing valve train components. Generally, exhaust braking requires components that can actuate (open) an exhaust valve independent of the normal valve train operation, under control of an exhaust brake system. Related art exhaust brake systems have included separate independent camshafts, rocker arms, or actuators to perform actuation of exhaust valves for exhaust braking. Related art devices have in the past actuated multiple exhaust valves in unison. This is of course the simplest operation conceptually, but simultaneous opening of both exhaust valves of a cylinder during exhaust braking has drawbacks.

The force required to open multiple valves is higher than the force required to open a single valve imposing a greater load upon the actuation components. The design for an exhaust brake assembly having single valve actuation is disclosed in Bartel et al., U.S. Pat. No. 6,234,143 B1 (May 22, 2001), the disclosure of which is incorporated herein by reference.

The exhaust brake assembly disclosed in Bartel '143 employs an engine exhaust brake assembly capable of opening a single valve of an exhaust valve pair. The exhaust brake assembly includes a rocker arm having a camshaft force receiving portion on a proximal end of the rocker arm for receiving a force applied by a camshaft, a valve actuation contact portion on a distal end of the rocker arm and a pivot point located between the proximal and distal ends. An exhaust valve pair, including a first valve and a second valve, is provided with valve stems for use in valve actuation. The first valve is closer to the pivot point of the rocker arm and inside the valve actuation contact portion of the rocker arm. A valve bridge extends across the valve stems.

Further, the valve bridge has a contact portion located between the valve stems, and corresponds to and contacts the valve actuation contact portion of the rocker arm. The valve bridge actuates the exhaust valve pair when the valve actuation contact portion of the rocker arm exerts a force upon the valve bridge as the rocker arm pivots in operation. An exhaust brake actuator formed between the pivot point and the distal end of the rocker arm includes an actuator piston having a retracted position and an extended position. The first valve of the exhaust valve pair may be opened by extension of the actuator piston of the exhaust brake actuator while the valve opening actuation portion of the rocker arm is out of contact with the central contact portion of the valve bridge.

The opening of only one exhaust valve during exhaust braking reduces the load imposed on the pushrod by fifty percent for any given cylinder pressure when compared to a two valve exhaust braking operation. The imposed load is even further reduced since the first exhaust valve (e.g., the valve closest to the rocker shaft) is the valve being opened. Accordingly, the engine braking performance can be optimized without being limited by cylinder pressures, and with less compliance in the valve train.

Another way of increasing the braking power of exhaust brakes is to perform exhaust gas recirculation in combination with exhaust braking. Generally, an exhaust valve is opened during the first half of a compression stroke of a piston for exhaust gas recirculation. Opening of the exhaust valve during this time permits higher pressure exhaust gas from the exhaust manifold to recirculate back into the cylinder. The recirculated exhaust gas increases the total mass in the cylinder at the time of a subsequent braking exhaust valve event, thereby increasing the braking effect realized by the braking exhaust valve event.

Recently, varying the overlap between the time an exhaust valve is opened for exhaust gas recirculation and the time an intake valve is opened for intake has been recognized. Varying the overlap significantly reduces emissions of NOx (oxides of nitrogen). A system that varies the opening times of intake and exhaust valves is disclosed in U.S. Provisional Appln. No. 60/360,005, filed Feb. 28, 2002, the disclosure of which is incorporated herein by reference in its entirety.

U.S. Provisional Appln. No. 60/360,005 discloses a lash system for varying the amount of lash between the actuation piston and an exhaust valve to be opened by the piston, and independently controlling the exhaust valve opening and closing using levels of pressure and temperature in the exhaust manifold and engine cylinders, etc. Also disclosed is injection rate shaping.

There are many prior art systems that perform both exhaust gas recirculation and engine exhaust braking in a single system using multiple valve actuation, such as, e.g., U.S. Pat. No. 6,170,474 (Isreal), U.S. Pat. No. 6,082,328 (Meistrick et al.), U.S. Pat. No. 6,012,424 (Meistrick), U.S. Pat. No. 5,809,964 (Meistrick et al.), U.S. Pat. No. 5,787, 859 (Meistrick et al.). However, there remains a need for, among other things, a method and system that performs both exhaust gas recirculation and engine exhaust braking using single valve actuation.

SUMMARY OF THE INVENTION

In preferred embodiments, a method and system is provided that performs both exhaust gas recirculation and engine exhaust braking using single valve actuation.

A first aspect of the preferred embodiments is generally applicable to a method of providing engine exhaust braking and exhaust gas recirculation for an engine having an exhaust manifold and a plurality of exhaust valves per cylinder during a four stroke engine cycle. The method comprises the step of (a) carrying out an exhaust braking event, comprising the steps of (a1) actuating a single exhaust valve beginning during a second half of a compression stroke continuing during a first half of an expansion stroke, and (a2) closing the exhaust valve beginning during a second half of an exhaust stroke, and the step of (b) carrying out an exhaust gas recirculation event, comprising the steps of (b1) reactuating the exhaust valve beginning during a first half of an intake stroke, and (b2) closing the exhaust valve beginning during a second half of the intake stroke, wherein the exhaust valve does not completely close during the exhaust braking event and the exhaust gas recirculation event.

A second aspect of the preferred embodiments is generally directed to a system for accomplishing engine exhaust braking and exhaust gas recirculation for an engine having an exhaust manifold and a plurality of exhaust valves per cylinder during a four stroke engine cycle. The system includes means for providing a valve train motion, and an actuation device operable to provide valve actuation of a single exhaust valve for an exhaust braking event and an exhaust gas recirculation event, wherein the exhaust valve is not completely closed during the exhaust braking event and the exhaust gas recirculation event. The exhaust braking event includes actuating a single exhaust valve beginning during a second half of a compression stroke and a first half of an expansion stroke, and closing the exhaust valve beginning during a second half of an exhaust stroke. The exhaust gas recirculation event includes reactuating the exhaust valve beginning during a first half of an intake stroke, and closing the exhaust valve beginning during a second half of the intake stroke.

The above and other features and advantages will be further understood from the following description of the preferred embodiment thereof, taken in conjunction with the accompanying drawings.

DETAILED DESCRIPTION OF THE PREFERRED EMBODIMENT(S)

Figure 1:
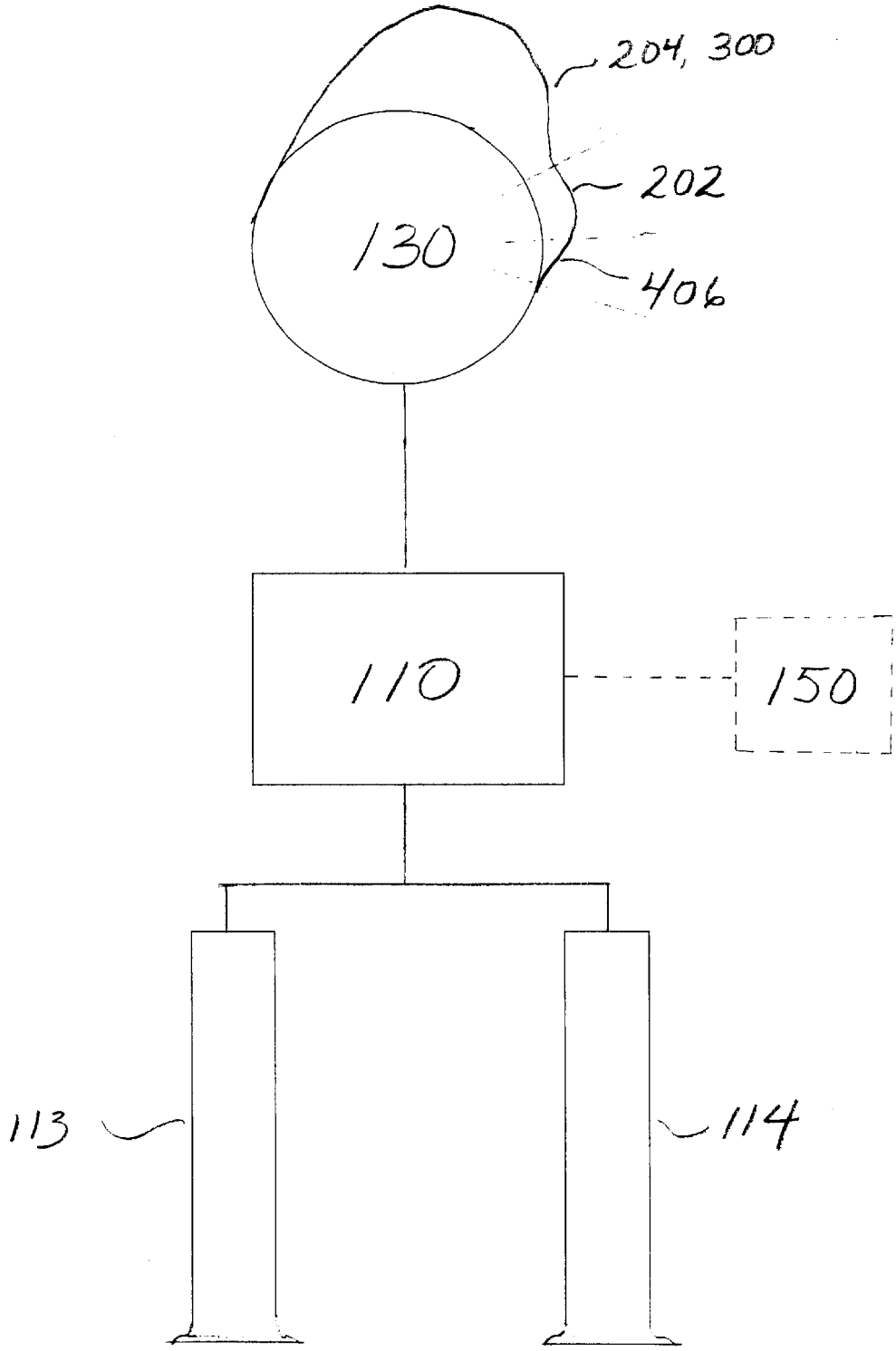
FIG. 1 is a schematic diagram of a system of the present invention.

Reference will now be made in detail to a preferred embodiment of the present invention, an example of which is illustrated in the accompanying drawings. Referring to FIG. 1, the system 10 of an embodiment of the present invention is capable of performing single valve actuation as disclosed in Bartel '143. Further, the system 10 is capable of combining exhaust gas recirculation and exhaust braking using single valve actuation.

The system 10 may provide these functions by using a valve actuation device 110 to provide the opening and closing of first and second exhaust valves 113 and 114, and a means for providing valve train motion in an engine valve train, such as a camshaft 130. The camshaft 130 may include lobes for a braking exhaust valve event 300, a normal exhaust valve event 204, an exhaust gas recirculation event 202, and a ramp down event 406.

The opening and closing times of the exhaust valves 113 and 114, and an intake valve (not shown) may be determined by the camshaft 130 profile (i.e., lobes 202, 204, 300, 306) and other factors. It will be appreciated that an additional means 150 for advancing the opening and closing times of the valves (e.g., controlling the airflow) may be selectively controlled and implemented in the present invention, as disclosed in U.S. Provisional Appln. No. 60/360,005. In this manner, the first exhaust valve 113 may remain open during an exhaust valve event (e.g., braking exhaust valve event, an altered normal exhaust valve event and an altered exhaust gas recirculation valve event) without decreasing the overall performance of the exhaust brakes.

Figure 3:
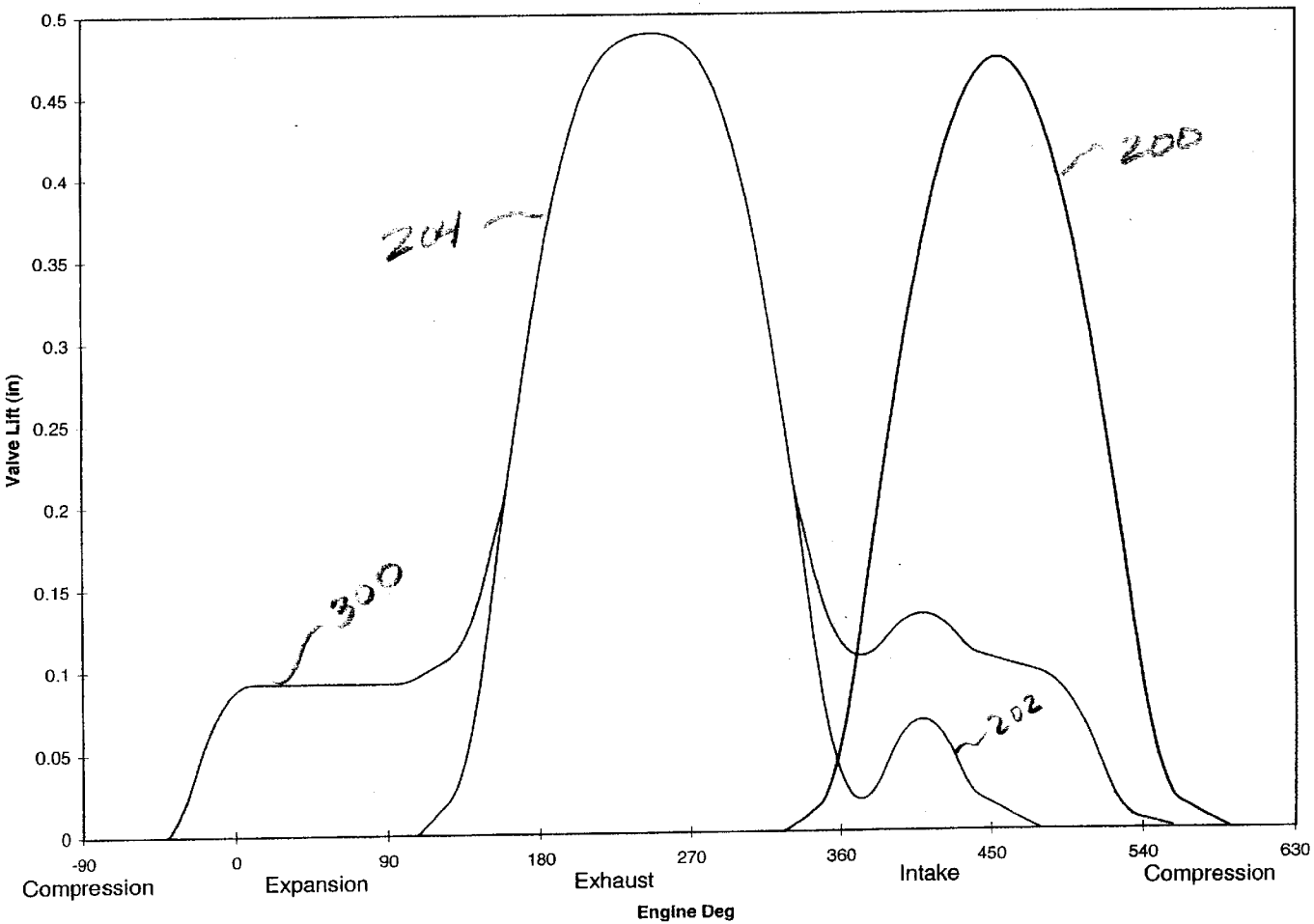
FIG. 3 shows a graph depicting valve motion of a first exhaust valve, a second exhaust valve and an intake valve during a four stroke engine cycle, with exhaust gas recirculation, according to a conventional system.

During engine braking, the motion contributed by the valve actuation device 110 to the motion (i.e., opening and closing) of multiple exhaust valves 113 and 114 may be illustrated in FIG. 3. The motion contributed by the valve actuation device 110 to the overall motion of single exhaust valve 113 may be illustrated in FIG. 4.

Figure 2:
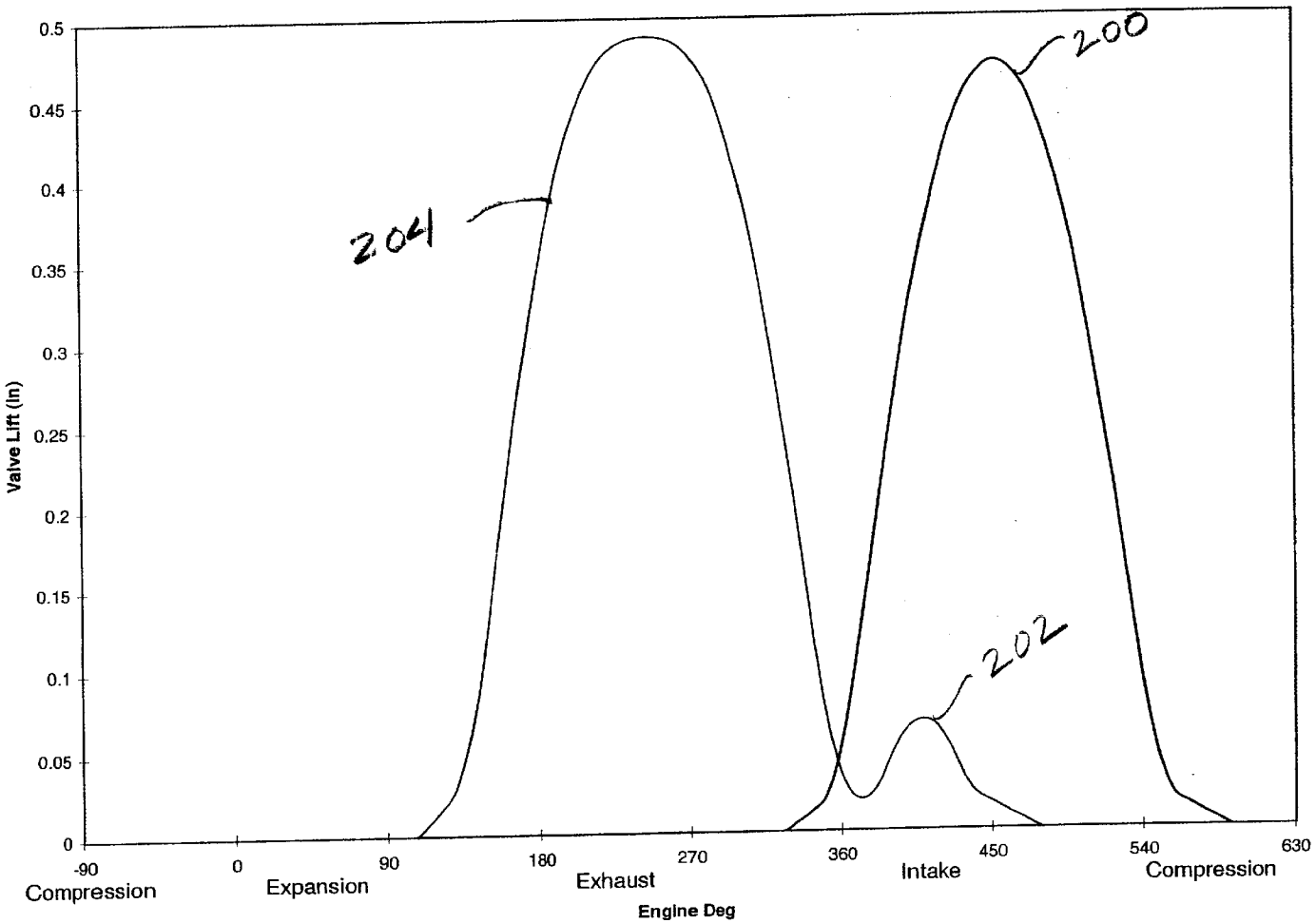
FIG. 2 shows a graph depicting valve motion of a second exhaust valve and an intake valve during a four stroke engine cycle, with exhaust gas recirculation, according to a conventional system.

FIG. 2 shows profiles of positive power valve events during a four stroke engine cycle. A full engine cycle contains four strokes: compression, expansion (power), exhaust and intake. There is 180 degrees of rotation for each stroke and a full cycle has 720 degrees of rotation. The full engine cycle is realized by two complete crankshaft rotations.

Referring to FIG. 2, the power valve events occur during normal engine operation. Area 200 illustrates the opening of the intake valve (not shown) (i.e., an intake valve event). The opening of the second exhaust valve 114 for exhausting combustion gases from an associated cylinder (not shown) may be shown by area 204 (i.e., a normal exhaust valve event) and for recirculation may be illustrated by area 202 (i.e., an exhaust gas recirculation valve event).

During the intake valve event 200, the intake valve is opened for a duration of approximately 180 to 270 engine degrees with a maximum lift of approximately 0.48 inches. As shown, the intake valve begins to open during the second half of the exhaust stroke and the first half of the intake stroke (at approximately 315 to 360 engine degrees) and begins to close during the second half of the intake stroke (at approximately 450 engine degrees). The intake valve closes completely during the first half of the compression stroke (at approximately 540 to 585 engine degrees).

The second exhaust valve 114 is opened (without closing) for both the normal exhaust valve event 204 and the exhaust gas recirculation valve event 202. During both the normal exhaust valve event 204 and the exhaust gas recirculation valve event 202, the second exhaust valve 114 is opened for a duration of approximately 292.5 to 360 engine degrees. As shown, the second exhaust valve 114 begins to open during the second half of the expansion stroke and the first half of the exhaust stroke (at approximately 112 to 135 engine degrees) and begins to close during the second half of the exhaust stroke (at approximately 247.5 engine degrees). During this time, the normal exhaust valve events are performed. The maximum lift of the second exhaust valve 114 during the normal exhaust valve event 204 is approximately 0.495 inches.

Further, the second exhaust valve 114 begins to reopen during the first half of the intake stroke (at approximately 371.25 to 393.75 engine degrees) and begins to close during the first half of the intake stroke (at approximately 405 engine degrees). The second exhaust valve 114 closes completely during the second half of the intake stroke (at approximately 473 engine degrees). During this time, the exhaust gas recirculation valve event is performed. The maximum lift of the second exhaust valve 114 during the exhaust gas recirculation valve event 202 is approximately 0.065 inches.

The exhaust gas recirculation valve event 202, as shown in FIG. 2, occurs entirely within the intake valve event 200 (i.e., the second half of the exhaust stroke and the first half of the intake stroke). It will be appreciated that the exhaust gas recirculation valve event 202 may occur during the beginning, the middle or the end of the intake valve event 200 in order to provide the desired amount of recirculation to the associated cylinder.

FIG. 3 shows profiles of an exhaust braking valve event performed during the same engine cycle as the positive power valve events of FIG. 2. The intake valve and the second exhaust valve 114 are actuated for the positive power valve events and the first exhaust valve 113 is actuated for the braking exhaust valve events. In other words, the intake valve, the first exhaust valve 113 and the second exhaust valve 114 will each be actuated during the full engine cycle.

Referring to FIG. 3, area 300 illustrates the opening of the first exhaust valve 113 for allowing compressed air in an associated cylinder to escape during the second half of the compression stroke and the first half of the expansion stroke (at approximately −45 to −22.5 engine degrees) (i.e., braking exhaust valve event). The first exhaust valve 113 has a maximum lift of approximately 0.095 inches during the braking exhaust valve event 300. The braking exhaust valve event 300 occurs during exhaust engine braking.

Figure 4:
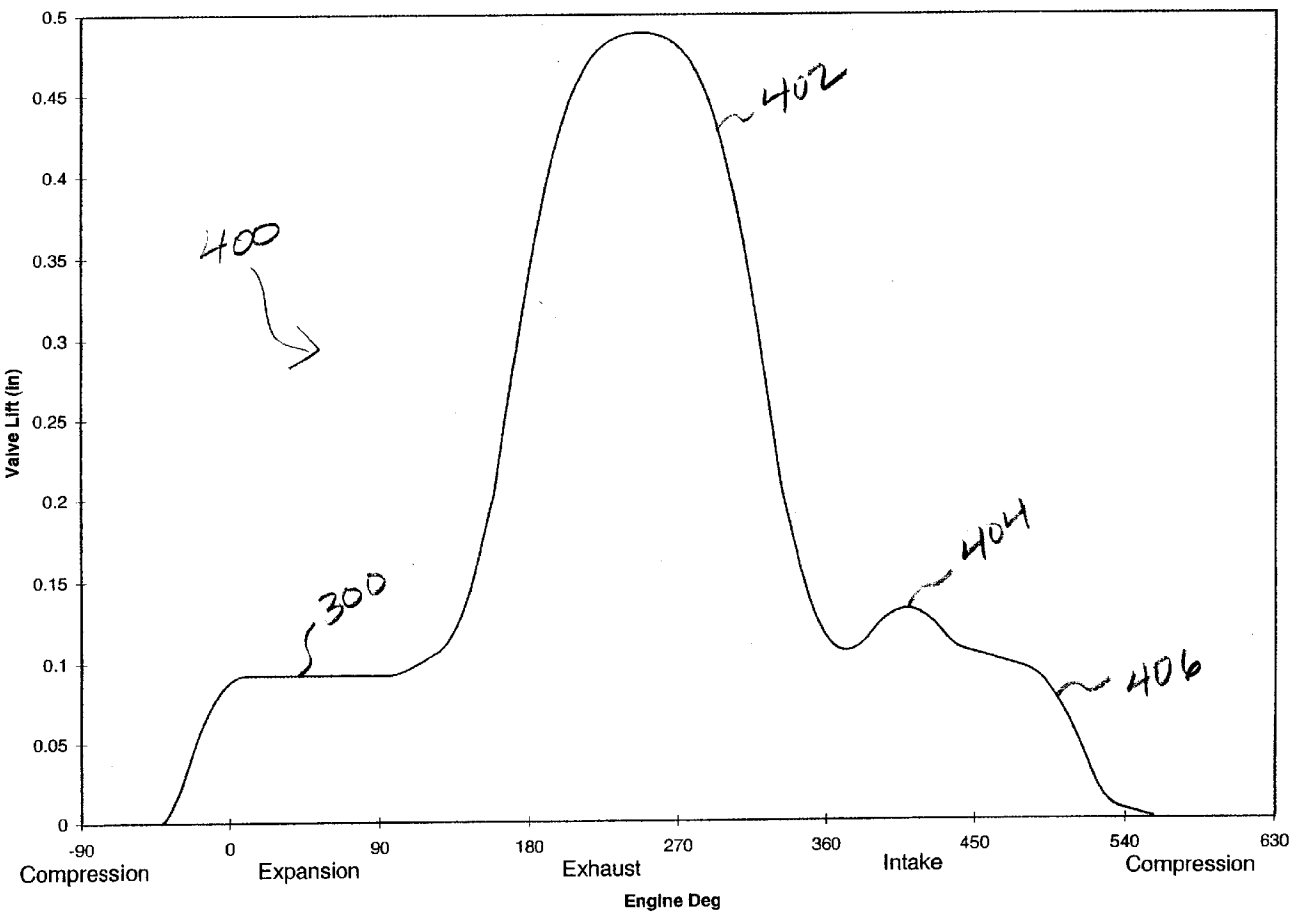
FIG. 4 shows a graph depicting valve motion of a first exhaust valve during a four stroke engine cycle, with exhaust gas recirculation, according to the present invention.

As illustrated in FIG. 3, multiple valve actuation is required, which imposes a larger load upon the actuation components. The system 10 of the preferred embodiments of the present invention, on the other hand, actuates a single exhaust valve (e.g., first exhaust valve 113) during the normal exhaust valve event (and the exhaust gas recirculation valve event) of FIG. 2 and the braking exhaust valve event of FIG. 3. In other words, the braking exhaust valve event 300 of FIG. 3 is added to the normal exhaust valve event 204 of FIG. 2 during the end of the compression stroke and beginning of the expansion stroke. Referring to FIG. 4, both the beginning and the end of the normal exhaust and exhaust gas recirculation valve events (of FIG. 2) are altered with single valve actuation. Area 402 illustrates an altered normal exhaust event and area 404 illustrates an altered exhaust gas recirculation event. Accordingly, the exhaust valve events 400 include a braking exhaust valve event 300, an altered normal exhaust valve event 402, an altered exhaust gas recirculation valve event 404, and a ramp down event 406 (discussed below).

As shown in FIG. 4, the first exhaust valve 113 is opened for a duration of approximately 585 engine degrees with a maximum lift of approximately 0.495 inches. The first exhaust valve 113 begins to open during the second half of the compression stroke and the first half of the expansion stroke (at approximately −45 to −22.5 engine degrees) and begins to close during the second half of the exhaust stroke (at approximately 247.5 engine degrees). During this time, both the braking exhaust valve event (which has a maximum valve lift of approximately 0.095 inches) and the normal exhaust valve events are performed.

The first exhaust valve 113 begins to reopen during the first half of the intake stroke (at approximately 371.25 engine degrees) and begins to close during the second half of the intake stroke (at approximately 405 engine degrees). During this time, the exhaust gas recirculation valve event is performed. The maximum lift of the exhaust gas recirculation event is approximately 0.131 inches +/−0.05 inches.

Further, a ramp down event 406 for connecting the exhaust gas recirculation event 404 back to zero inches (valve lift) occurs during the end (second half) of the intake stroke and a first half of the compression stroke (at approximately 438.75 engine degree).

The duration of the exhaust braking event is approximately 416.25+/−25 engine degrees, the duration of the braking exhaust valve event is approximately 202.5+/−25 engine degrees, the duration of the normal exhaust valve event is approximately 213.75+/−25 engine degrees, and the duration of the braking exhaust valve event and the normal exhaust valve event is approximately 416.25+/−25 engine degrees. The duration of the exhaust gas recirculation event is approximately 168.75+/−25 engine degrees, and the duration of the exhaust braking event and the exhaust gas recirculation event combined is approximately 585+/−25 engine degrees. The duration of the ramping down event is approximately 101.25+/−25 engine degrees.

Figure 5:
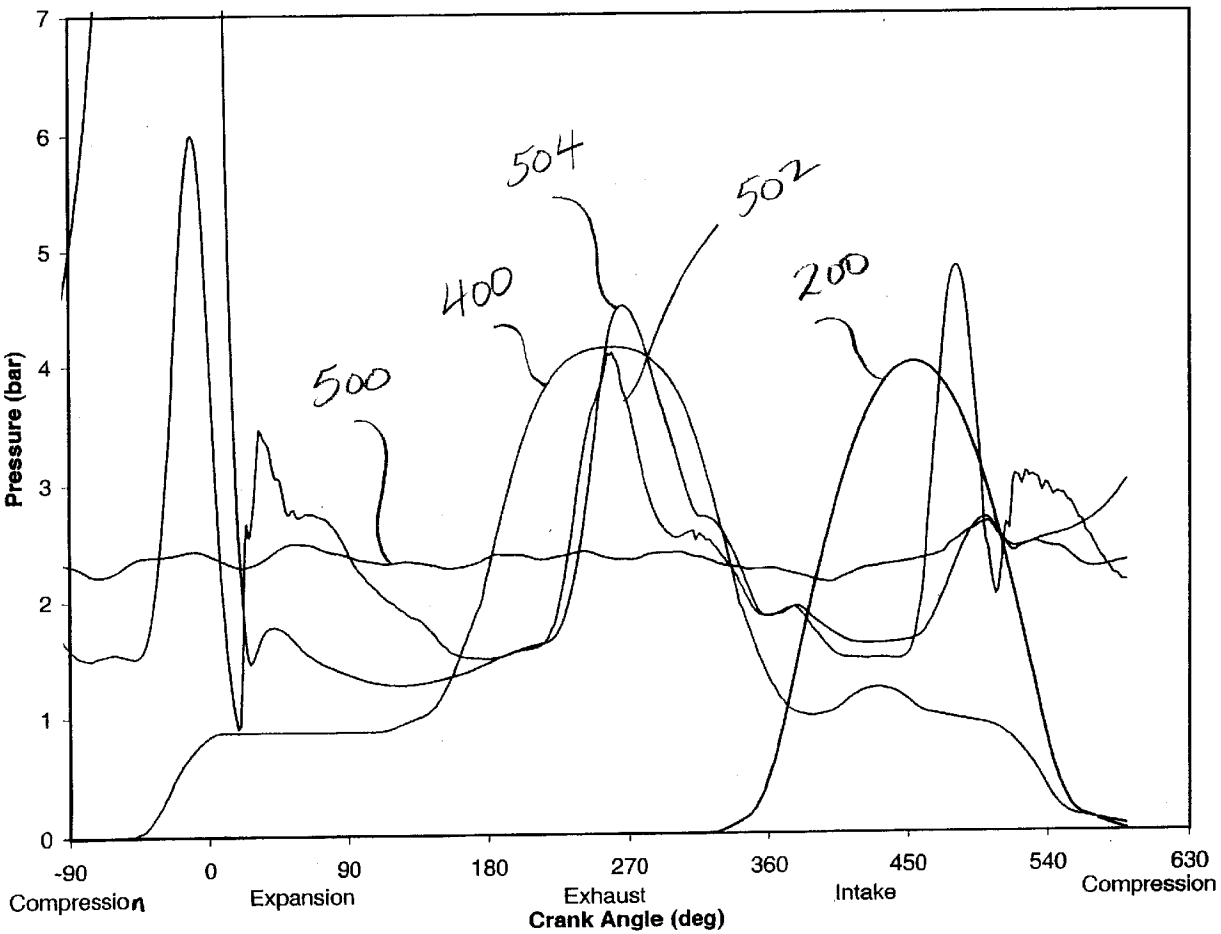
FIG. 5 is a graph showing valve events and pressures as a function of crank angle.

The system 10 of the preferred embodiments of the present invention is advantageous because during the intake stroke, the presence of the altered exhaust gas recirculation event 404 and the ramp down event 406 allow exhaust mass to flow back into the cylinder (corresponding to the first exhaust valve 113) due to higher exhaust manifold pressure 502 than intake manifold pressure 500 (FIG. 5). Inasmuch, the negative work of the engine during the compression stroke is increased. Further, pulse energy to a turbocharger is increased such that additional mass is forced into the cylinder (cylinder pressure 504) to further increase the negative work of the engine during the compression stroke.

While the invention has been described in detail above, the invention is not intended to be limited to the specific embodiments as described. It is evident that those skilled in the art may now make numerous uses and modifications of and departures from the specific embodiments described herein without departing from the inventive concepts.

What is claimed is:

1. A method of providing engine exhaust braking and exhaust gas recirculation for an engine having an exhaust manifold and a plurality of exhaust valves per cylinder during a four stroke engine cycle, comprising the steps of:

(a) carrying out an exhaust braking event, comprising the steps of:

(a1) actuating a single exhaust valve beginning during a second half of a compression stroke and a first half of an expansion stroke, and (a2) closing said exhaust valve beginning during a second half of an exhaust stroke; and (b) carrying out an exhaust gas recirculation event, comprising the steps of:

(b1) reactuating said exhaust valve beginning during a first half of an intake stroke, and (b2) closing said exhaust valve beginning during a second half of said intake stroke, wherein said exhaust valve does not completely close during said exhaust braking event and said exhaust gas recirculation event.

2. The method of claim 1, further comprising the step of (c) carrying out a ramping down event, comprising the step of:

(c1) completely closing said exhaust valve beginning during said second half of said intake stroke and ending during a first half of a compression stroke.

3. The method of claim 1, wherein said exhaust braking event includes a braking exhaust valve event and a normal exhaust valve event, wherein said braking exhaust valve event allows compressed air in a cylinder associated with said exhaust valve to escape, and wherein said normal exhaust valve event allows combustion gases from a cylinder associated with said exhaust valve to escape.

4. The method of claim 1, wherein said exhaust gas recirculation event allows exhaust gas from the exhaust manifold to recirculate back into a cylinder associated with said exhaust valve.

5. The method of claim 2, wherein a duration of said exhaust braking event is selectively controlled, a duration of said exhaust gas recirculation event is selectively controlled, a duration of said exhaust braking event and said gas recirculation event combined is selectively controlled, a duration of said ramping down event is selectively controlled, a maximum lift of said exhaust braking event is selectively controlled, and a maximum lift of said exhaust gas recirculation event is selectively controlled.

6. The method of claim 3, wherein a duration of said braking exhaust valve event is selectively controlled, a duration of said normal exhaust valve event is selectively controlled, a duration of said braking exhaust valve event and said normal exhaust valve event combined is selectively controlled, a maximum lift of said braking exhaust valve event is selectively controlled, and a maximum lift of said normal exhaust valve event is selectively controlled.

7. The method of claim 3, wherein a duration of said exhaust braking event is 416.25 engine degrees +/−25 engine degrees, a duration of said braking exhaust valve event is 202.5 engine degrees +/−25 engine degrees, a duration of said normal exhaust valve event is 213.75 engine degrees +/−25 engine degrees, a duration of said exhaust gas recirculation event is 168.75 engine degrees +/−25 engine degrees, and a duration of said exhaust braking event and said exhaust gas recirculation event combined is 585 engine degrees +/−25 engine degrees.

8. The method of claim 2, wherein a duration of said ramping down event is 101.25 engine degrees +/−25 engine degrees.

9. The method of claim 3, wherein a maximum lift of said braking exhaust valve event is 0.095 inches +/−0.05 inches, a maximum lift of said normal exhaust valve event is 0.495 inches +/−0.05 inches, and a maximum lift of said exhaust gas recirculation event is 0.131 inches +/−0.05 inches.

10. The method of claim 1, further including the exhaust valve remaining open from after the exhaust gas recirculation event until after a ramp down event.

11. A system for providing engine exhaust braking and exhaust gas recirculation for an engine having an exhaust manifold and a plurality of exhaust valves per cylinder during a four stroke engine cycle, comprising:

means for providing a valve train motion; and an actuation device operable to provide valve actuation of a single exhaust valve for an exhaust braking event and an exhaust gas recirculation event, said exhaust valve not completely closing during said exhaust braking event and said exhaust gas recirculation event, wherein said exhaust braking event includes actuating a single exhaust valve beginning during a second half of a compression stroke and a first half of an expansion stroke, and closing said exhaust valve beginning during a second half of an exhaust stroke, and said exhaust gas recirculation event includes reactuating said exhaust valve beginning during a first half of an intake stroke, and closing said exhaust valve beginning during a second half of said intake stroke.

12. The system of claim 11, wherein said actuation device is operable to provide single valve actuation of said exhaust valve for a ramping down event, wherein said ramping down event includes completely closing said exhaust valve beginning during said second half of said intake stroke and ending during a first half of a compression stroke.

13. The system of claim 11, wherein said exhaust braking event includes a braking exhaust valve event and a normal exhaust valve event, said braking exhaust valve event allows compressed air in a cylinder associated with said exhaust valve to escape, said normal exhaust valve event allows combustion gases from a cylinder associated with said exhaust valve to escape, and said exhaust gas recirculation event allows exhaust gas from the exhaust manifold to recirculate back into a cylinder associated with said exhaust valve.

14. The system of claim 13, wherein a duration of said braking exhaust valve event is selectively controlled, a duration of said normal exhaust valve event is selectively controlled, a duration of said exhaust gas recirculation event is selectively controlled, a duration of said exhaust braking event and said exhaust gas recirculation event combined is selectively controlled, a maximum lift of said exhaust braking event is selectively controlled, a maximum lift of said braking exhaust valve event is selectively controlled, a maximum lift of said normal exhaust valve event is selectively controlled, and a maximum lift of said exhaust gas recirculation event is selectively controlled.

15. The system of claim 12, wherein a duration of said ramping down event is selectively controlled.

16. The system of claim 13, wherein a duration of said exhaust braking event is 416.25 engine degrees +/−25 engine degrees, a duration of said braking exhaust valve event is 202.5 engine degrees +/−25 engine degrees, a duration of said normal exhaust valve event is 213.75 engine degrees +/−25 engine degrees, a duration of said exhaust gas recirculation event is 168.75 engine degrees +/−25 engine degrees, and a duration of said exhaust braking event and said exhaust gas recirculation event combined is 585 engine degrees +/−25 engine degrees.

17. The system of claim 12, wherein a duration of said ramping down event is 101.25 engine degrees +/25 engine degrees.

18. The system of claim 13, wherein a maximum lift of said braking exhaust valve event is 0.095 inches +/−0.05 inches, a maximum lift of said normal exhaust valve event is 0.495 inches +/−0.05 inches, and a maximum lift of said exhaust gas recirculation event is 0.131 inches +/−0.05 inches.

19. The system of claim 11, further including that said exhaust valve remains open after the exhaust gas recirculation event until after a ramp down event.

* * * * *